US009605668B2

(12) United States Patent
Yaschur

(10) Patent No.: US 9,605,668 B2
(45) Date of Patent: Mar. 28, 2017

(54) QUICK RELEASE PUMP CLAMP

(75) Inventor: Jefferey C. Yaschur, Doylestown, PA (US)

(73) Assignee: Ingersoll-Rand Company, Davidson, NC (US)

( * ) Notice: Subject to any disclaimer, the term of this patent is extended or adjusted under 35 U.S.C. 154(b) by 364 days.

(21) Appl. No.: 14/356,304

(22) PCT Filed: Nov. 16, 2011

(86) PCT No.: PCT/US2011/061006

§ 371 (c)(1),
(2), (4) Date: May 5, 2014

(87) PCT Pub. No.: WO2013/074100

PCT Pub. Date: May 23, 2013

(65) Prior Publication Data

US 2014/0255228 A1 Sep. 11, 2014

(51) Int. Cl.

| | |
|---|---|
| ***F04B 43/02*** | (2006.01) |
| ***F04B 43/00*** | (2006.01) |
| ***F04B 53/16*** | (2006.01) |
| ***F04B 53/22*** | (2006.01) |

(52) U.S. Cl.

CPC ..... *F04B 43/02* (2013.01); *F04B 43/0054* (2013.01); *F04B 53/16* (2013.01); *F04B 53/22* (2013.01)

(58) Field of Classification Search

CPC .... F04B 43/0736; F04B 43/02; F04B 43/026; F04B 43/0054; F04B 53/101; F04B 53/22; F04B 39/12; F04B 39/14

USPC ..... 417/534; 92/98 R

See application file for complete search history.

(56) References Cited

U.S. PATENT DOCUMENTS 1,681,150 A * 8/1928 Vischer, Jr. ..... A47J 27/0813 220/240
3,269,587 A 8/1966 Svenson
4,157,146 A * 6/1979 Svenson ..... F16J 13/06 220/324

(Continued)

FOREIGN PATENT DOCUMENTS

GB 2105819 A * 3/1983 ..... F04B 43/0054

OTHER PUBLICATIONS

PCT/US2011/061006. International Search Report. Dated Aug. 28, 2012, 3 pages.

(Continued)

*Primary Examiner* — Devon Kramer
*Assistant Examiner* — Kenneth J Hansen
(74) *Attorney, Agent, or Firm* — Barnes & Thornburg LLP

(57) ABSTRACT

A diaphragm pump includes a first plate, a second plate and a diaphragm having first and second side surfaces. A fluid chamber is defined by the first plate and the first side of the diaphragm, a fluid inlet fluidly connected to the fluid chamber and a fluid outlet fluidly connected to the fluid chamber. An air chamber is defined by the second plate and the second side of the diaphragm, such that the diaphragm is retained between the first plate and the second plate. A clamp moves between a first position in which the first plate is fixedly connected to the second plate and the diaphragm, and a second position in which the first plate is disconnected from the second plate and the diaphragm to permit disassembly of the first plate, the second plate and the diaphragm.

17 Claims, 13 Drawing Sheets

(56) References Cited

U.S. PATENT DOCUMENTS

| | | | | |
|---|---|---|---|---|
| 4,728,267 | A | 3/1988 | Ruttenberg et al. | |
| 4,778,356 | A | 10/1988 | Hicks | |
| 5,169,296 | A * | 12/1992 | Wilden | F04B 43/0736 417/395 |
| 6,526,867 | B2 | 3/2003 | Anderson | |
| 7,004,512 | B2 | 2/2006 | Antonelli et al. | |
| 7,063,516 | B2 * | 6/2006 | Bethel | F04B 43/0736 137/533.11 |

OTHER PUBLICATIONS

PCT/US2011/061006. International Preliminary Report on Patentability. Dated Feb. 25, 2014, 13 pages.
PCT/US2011/061006. Written Opinion of the International Searching Authority. Dated Aug. 28, 2012, 4 pages.
PCT/US2011/061006. Response Under PCT Rule 66.3. Dated Dec. 19, 2013, 6 pages.
PCT/US2011/061006. Article 34 Amendment and Response to Written Opinion. Dated Feb. 5, 2013, 21 pages.
PCT/US2011/061006. Written Opinion of the International Preliminary Examining Authority. Dated Oct. 22, 2013, 5 pages.

* cited by examiner

QUICK RELEASE PUMP CLAMP

BACKGROUND

The present invention relates to diaphragm pumps and clamps for securing various components of the diaphragm pumps.

SUMMARY

In one embodiment, the invention provides a diaphragm pump including a first plate, a second plate, and a diaphragm having first and second oppositely facing sides. A fluid chamber is defined by the first plate and the first side of the diaphragm, a fluid inlet is fluidly connected to the fluid chamber and a fluid outlet is fluidly connected to the fluid chamber. An air chamber is defined between the second plate and the second side of the diaphragm, such that the diaphragm is retained between the first plate and the second plate. A clamp moves between a first position in which the clamp fixedly connects the first plate, the second plate and the diaphragm, and a second position in which the clamp disconnects the first plate, the second plate and the diaphragm to permit disassembly of the first plate, the second plate and the diaphragm.

In another embodiment the invention provides a diaphragm pump including a first plate, a second plate, and a diaphragm having first and second oppositely facing sides. A fluid chamber is defined by the first plate and the first side of the diaphragm, a fluid inlet is fluidly connected to the fluid chamber, and a fluid outlet is fluidly connected to the fluid chamber. An air chamber is defined between the second plate and the second side of the diaphragm, such that the diaphragm is retained between the first plate and the second plate. A clamp is moveable between a first position in which the clamp fixedly connects the first plate, the second plate and the diaphragm, and a second position in which the clamp does not connect the first plate, the second plate and the diaphragm to permit disassembly of the first plate, the second plate and the diaphragm.

In another embodiment the invention provides a diaphragm pump including a first plate, a second plate, and a diaphragm having first and second oppositely facing sides. A fluid chamber is defined by the first plate and the first side of the diaphragm, a fluid inlet is fluidly connected to the fluid chamber and a fluid outlet fluidly connected to the fluid chamber. An air chamber is defined between the second plate and the second side of the diaphragm, such that the diaphragm is retained between the first plate and the second plate. A first clamp moves between a first position in which the first clamp fixedly connects the first plate, the second plate and the diaphragm, and a second position in which the first clamp disconnects the first plate, the second plate and the diaphragm to permit disassembly of the first plate, the second plate and the diaphragm. A groove is defined in an outer perimeter of the other of the first plate and the second plate, such that the first clamp engages the groove in the first position and is removed from the groove in the second position. The pump further includes a second clamp and an inlet pipe, such that the second clamp fixedly connects the fluid inlet to the inlet pipe, such that the second clamp moves between a first position in which the second clamp fixedly connects fluid inlet to the inlet pipe, and a second position in which the second clamp disconnects the fluid inlet and the inlet pipe to permit disassembly of the fluid inlet and the inlet pipe. The pump further includes a third clamp and an outlet pipe, such that the third clamp fixedly connects the fluid outlet to the outlet pipe, such that the third clamp moves between a first position in which third clamp fixedly connects the fluid outlet and the outlet pipe, and a second position in which the third clamp disconnects the fluid outlet and the outlet pipe to permit disassembly of the fluid outlet and the outlet pipe. A pin extends through an aperture in the diaphragm, such that the pin fixedly connects the diaphragm between the first plate and the second plate. The pump further includes a rib on the diaphragm and a groove in at least one of the first and second plates, such that the rib engages the groove to sealingly connect the diaphragm to the one of the first and second plates.

In some embodiments, the first plate includes a protrusion that at least partially overlaps the second plate. When the clamp is installed, the overlap provides a strong seal between the first plate and the second plate. In some embodiments, the overlap provides a mounting location for the clamp.

In some embodiments, a tapered surface is provided on one or more of the first and second plates. When the clamp is installed, the tapered surface urges the first and/or second plates into engagement with the diaphragm to provide a strong seal between the diaphragm and the first and second plates.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
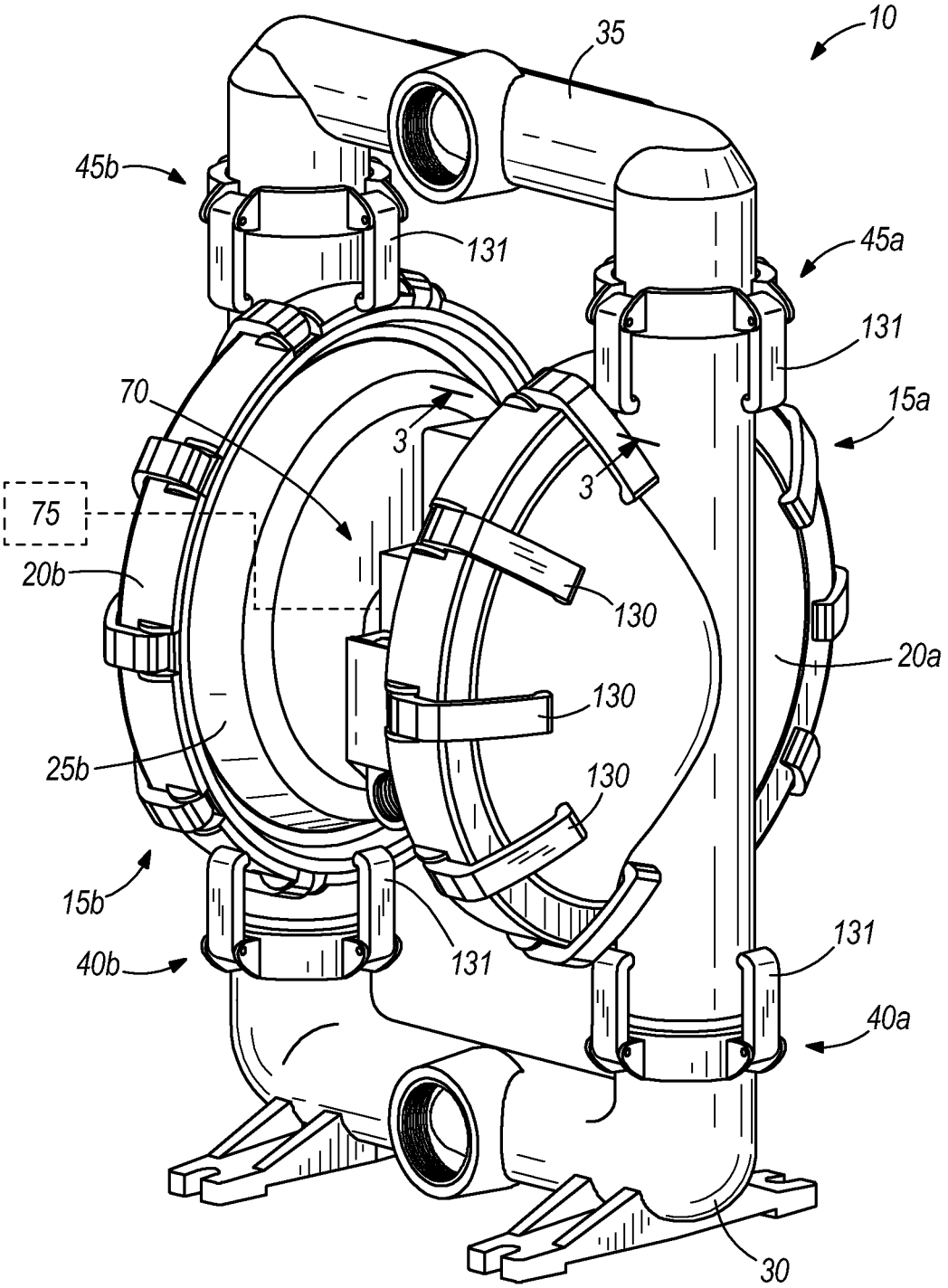
FIG. 1 is a perspective view of a double-diaphragm pump having a first clamp embodiment.
Figure 2:
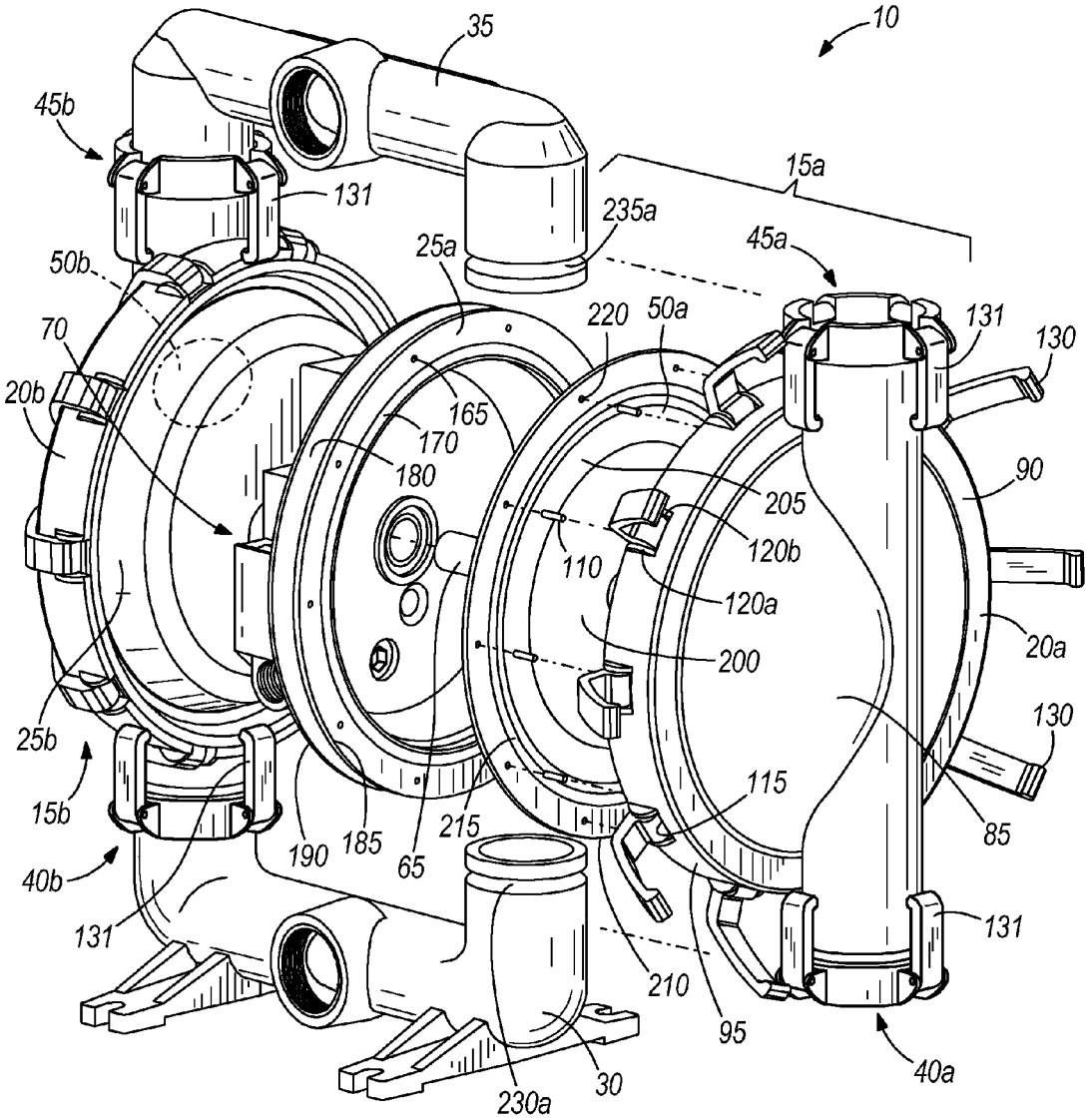
FIG. 2 is an exploded view of the clamp embodiment of FIG. 1.

FIGS. 1 and 2 illustrate a prime mover, such as a double diaphragm pump 10 having a housing defining two working chambers 15*a*, 15*b*. In other embodiments, the prime mover may be another type of double-diaphragm pump, a piston pump, a motor or any other machinery having a reciprocating or moving part to be monitored. The working chambers 15*a*, 15*b* are defined by respective fluid caps 20*a*, 20*b* and air caps 25*a*, 25*b*. The pump 10 includes an inlet manifold 30 and an outlet manifold 35. The inlet manifold 30 is fluidly coupled to an inlet 40*a* of the working chamber 15*a* and is fluidly coupled to an inlet 40*b* of the working chamber 15*b*. The outlet manifold 35 is fluidly coupled to an outlet 45*a* of the working chamber 15*a* and is fluidly coupled to an outlet 45*b* of the working chamber 15*b*.

Figure 3:
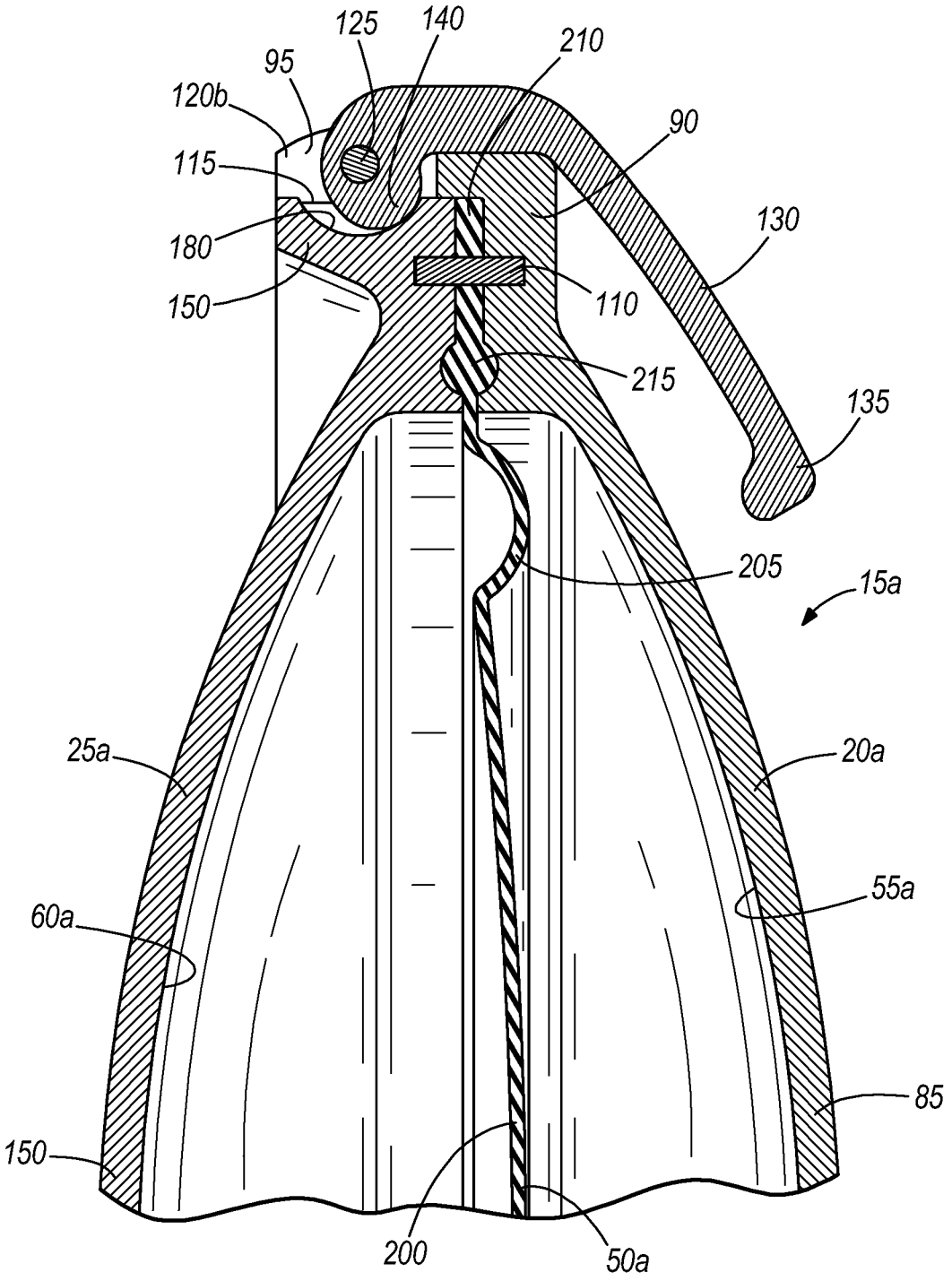
FIG. 3 is a cross-sectional view of the clamp of FIGS. 1 and 2 in an engaged position, taken along line 3-3 of FIG. 1.
Figure 4:
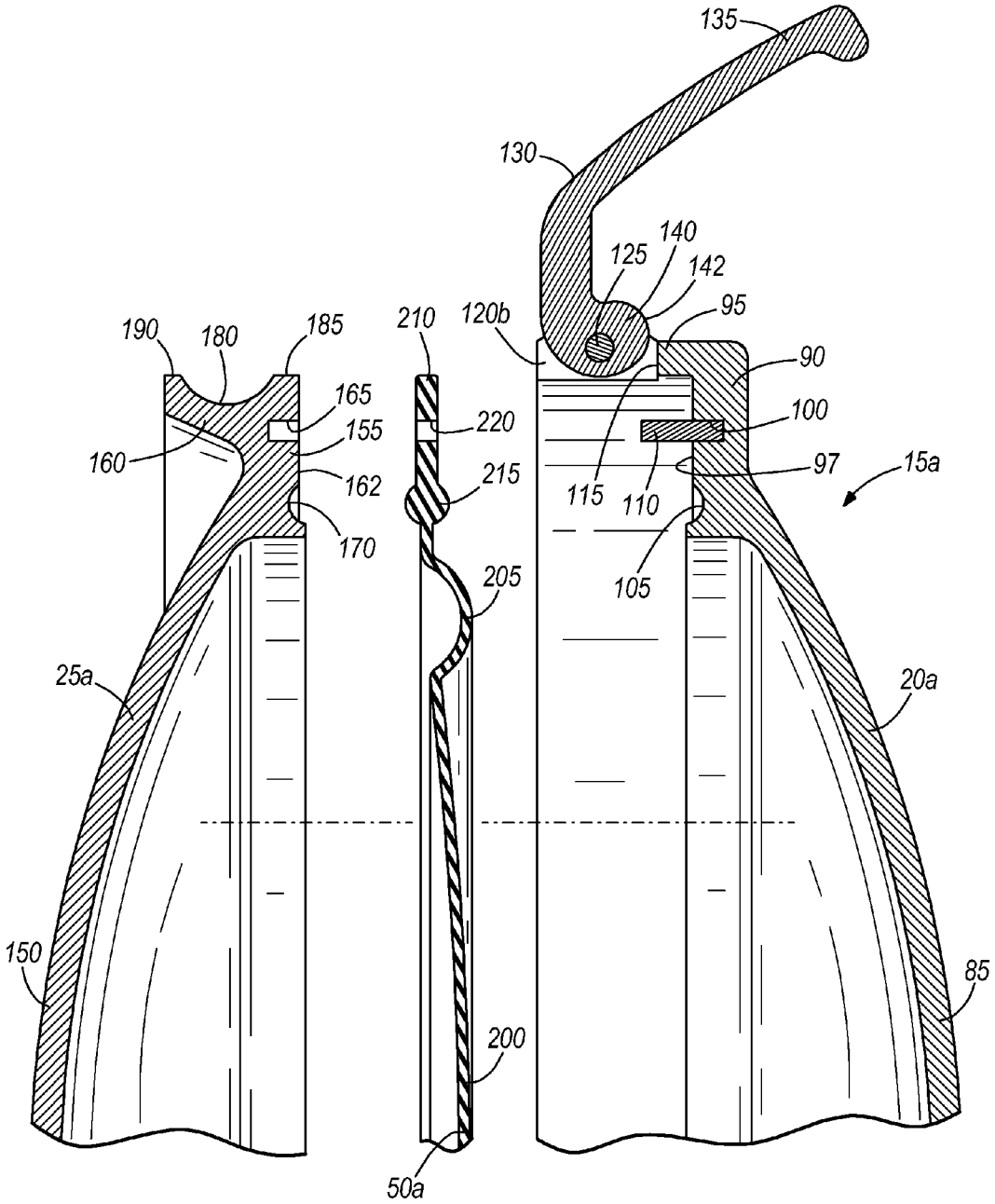
FIG. 4 is a cross-sectional view of the clamp of FIGS. 1-3 in a disengaged position, taken along line 3-3 of FIG. 1.

The working chamber 15*a* is divided with a flexible diaphragm 50*a* into a pumping chamber 55*a* and a motive fluid chamber 60*a*, see FIGS. 3-4. The working chamber 15*b* is divided with a flexible diaphragm 50*b* into a pumping chamber 55*b* and a motive fluid chamber 60*b*. The diaphragms 50*a*, 50*b* are interconnected through a shaft 65 for synchronized reciprocating movement, such that when one diaphragm 50*a*, 50*b* is moved to increase the volume of the associated pump chamber 55*a*, 55*b*, the other diaphragm 50*a*, 50*b* is simultaneously moved to decrease the volume of the associated pump chamber 55*a*, 55*b*. The shaft 65 illustrated in FIG. 2 is a reciprocating rod.

The pump 10 further includes a valve 70 moveable between first and second positions which alternatingly fluidly couples a source of motive fluid 75 with the motive fluid chambers 60*a*, 60*b*. Alternatingly supplying the motive fluid 75 to the motive fluid chambers 60*a*, 60*b* drives reciprocation of the first and second diaphragms 50*a*, 50*b* and the shaft 65. Simultaneously with supplying the motive fluid 75 to one of the motive fluid chambers 60*a*, 60*b*, the valve 70 places the other motive fluid chamber 60*a*, 60*b* in fluid communication with atmosphere to permit motive fluid 75 to be expelled therefrom. The motive fluid chamber 60*a* is in fluid communication with the source of motive fluid 75 when the motive fluid chamber 60*b* is in fluid communication with atmosphere when the shaft 65 is in a first position. Likewise, the motive fluid chamber 60*b* is in fluid communication with the source of motive fluid 75 when the motive fluid chamber 60*a* is in fluid communication with atmosphere when the shaft 65 is in a second position.

The inlets 40*a*, 40*b* and the outlets 45*a*, 45*b* are each provided with a one-way check valve to permit flow from the inlet manifold 30 into the inlets 40*a*, 40*b* and permit flow from the outlets 45*a*, 45*b* into the outlet manifold 35. The one-way check valves inhibit flow from the outlet manifold 35 back through the outlets 45*a*, 45*b* and inhibit flow from the pump chambers 55*a*, 55*b* back through the inlets 40*a*, 40*b*. The check valves ensure that the fluid being pumped moves only from the inlet manifold 30 toward the outlet manifold 35. In operation, as the diaphragms 50*a*, 50*b* and shaft 65 reciprocate, the pump chambers 55*a*, 55*b* alternatingly expand and contract to create respective low and high pressure within the respective chambers 55*a*, 55*b*. The pump chambers 55*a*, 55*b* communicate with an inlet manifold 30 that is connected to a reservoir containing a fluid to be pumped, and also communicate with an outlet manifold 35 that is connected to a receptacle for the fluid being pumped. Further details regarding the function of the pump are disclosed in U.S. Patent Application Publication No. 2010/0196168, the entire contents of which are herein incorporated by reference.

Working chamber 15*a* is shown in greater detail in FIGS. 2-4. Working chamber 15*b* is a substantial mirror image of working chamber 15*a*. Therefore, only the working chamber 15*a* will be described in detail, as the disclosure of working chamber 15*a* also applies to working chamber 15*b*.

With reference to FIGS. 3-4, the fluid cap 20*a* is a substantially circular plate 85 having a first peripheral flange 90 extending radially outwardly therefrom and a second peripheral flange 95 extending axially from the first peripheral flange 90. The substantially circular plate 85 and the diaphragm 50*a* define the working chamber 15*a*. The first peripheral flange 90 includes a first ring-shaped mating surface 97 in which is formed a plurality of blind bores 100 and a ring shaped channel 105 having a smooth, radiused concave profiled. The plurality of blind bores 100 are substantially cylindrical. In the illustrated embodiment, a pin 110 is positioned within each of the plurality of blind bores 100 and extends outwardly therefrom.

The second peripheral flange 95 defines a plurality of apertures 115 extending therethrough and a plurality of first and second outwardly extending ribs 120*a*, 120*b*, such that the first outwardly extending ribs 120*a* are positioned on a first side of each of the plurality of apertures 115 and the second outwardly extending ribs 120*b* on a second side of each of the plurality of apertures 115. A plurality of pins 125 are provided, such that each pin 125 extends between respective first and second ribs 120*a*, 120*b*. A respective cam clamp 130 is coupled to each of the plurality of pins 125. The cam clamps 130 are rotatable about the respective pins 125 between a first position (shown in FIGS. 1 and 3) and a second position (shown in FIGS. 2 and 4). Each cam clamp 130 includes a clamp handle 135 and a cam end 140. The cam end 140 defines a cam surface 142 of increasing radial distance from the pin 125.

The air cap 25*a* is a substantially circular plate 150 having a first peripheral flange 155 extending radially outwardly therefrom and a second peripheral flange 160 extending axially from the first peripheral flange 155. The substantially circular plate 150 and the diaphragm 50*a* define the motive fluid chamber 60*a*. The first peripheral flange 155 includes a first ring-shaped mating surface 162 in which is formed a plurality of blind bores 165 and a ring shaped channel 170 having a smooth, radiused concave profiled. The first plurality of blind bores 165 are substantially cylindrical. In the illustrated embodiment, the pin 110 is positioned within each of the plurality of blind bores 165 and extends outwardly therefrom.

The second peripheral flange 160 defines a circumferential groove 180 between first and second circumferential ribs 185, 190. The circumferential groove 180 is sized to receive at least a portion of the cam end 140 when the cam clamps 130 are in the first position.

The diaphragm 50*a* includes a substantially circular portion 200, a circumferential projection 205 which permits the diaphragm 50*a* to have flexibility to move toward the fluid cap 20*a* or toward the air cap 25*a*. The diaphragm 50*a* further includes a peripheral flange 210 extending axially outward from the circumferential projection 205. The peripheral flange 210 includes a circumferential protrusion 215 that has a substantially circular cross-section. The channels 105 and 170 are sized to receive the circumferential protrusion 215 therein. The peripheral flange 210 also defines a plurality of apertures 220. The plurality of apertures 220 are each sized to receive a respective one of the pins 110 therethrough. The substantially circular portion 200, the circumferential projection 205, the peripheral flange 210 and the circumferential protrusion 215 are integrally formed and comprise a flexible, resilient, non-reactive material, such as rubber.

In order to assemble the working chamber 15*a*, the cam clamps 130 are rotated to the second position (shown in FIGS. 2 and 4) and the diaphragm 50*a* is coupled to the fluid cap 20*a* by inserting the pins 110 through the respective apertures 220 and into blind bores 100. The air cap 25*a* is coupled to the diaphragm 50*a* and the fluid cap 20*a* by inserting the pins 110 into the respective blind bores 165. The circumferential protrusion 215 is received within the channels 105 and 170. The cam clamps 130 are then rotated to the first position (shown in FIGS. 1 and 3) to compress the diaphragm 50*a* between the fluid cap 20*a* and the air cap 25*a*, to make the pump chamber 55*a* and the working fluid chamber 60*a*, respectively substantially fluid-tight. The cam surface 142 presses against the circumferential groove 180 with increasing force as the cam clamp 130 is rotated from the second position to the first position. The cam clamp 130 is in an over-center position in FIG. 3, which is self-energizing to bias the cam clamp 130 to stay in the first position. The second peripheral flange 95 of the fluid cap 20*a* overlaps at least a portion of the peripheral flange 160 of the air cap 25*a*. The overlap securely contains the peripheral flange 210 of the diaphragm 50*a* between the fluid cap 20*a* and the air cap 25*a*, and forms a substantially air-tight seal around a perimeter of the working chamber 15*a*.

The pump 10 can be assembled without the use of tools, because an operator can rotate the cam clamps 130 about the respective pins 125 to secure the fluid caps 20*a*, 20*b* to the respective air caps 25*a*, 25*b*. In another embodiment, the cam clamps 130 are provided on the air caps 25*a*, 25*b* and the respective grooves are provided on the fluid caps 20*a*, 20*b*.

As shown in FIGS. 1 and 2, the inlet manifold 30 and the outlet manifold 35 are similarly coupleable to the inlets 40*a*, 40*b* and the outlets 45*a*, 45*b*, respectively by cam clamps 131. The inlet manifold 30 defines at least one groove 230*a* engageable by the cam clamps 131. The outlet manifold also defines at least one groove 235*a* engageable by the cam clamps 131. The inlet manifold 30 and outlet manifold 35 are coupleable to the inlets 40*a*, 40*b* and the outlets 45*a*, 45*b*, respectively, without the use of tools. In another embodiment, the cam clamps 131 are provided on the inlet manifold 30 and the outlet manifold 35 and respective grooves are provided on the inlets 40*a*, 40*b* and the outlets 45*a*, 45*b*.

Figure 5:
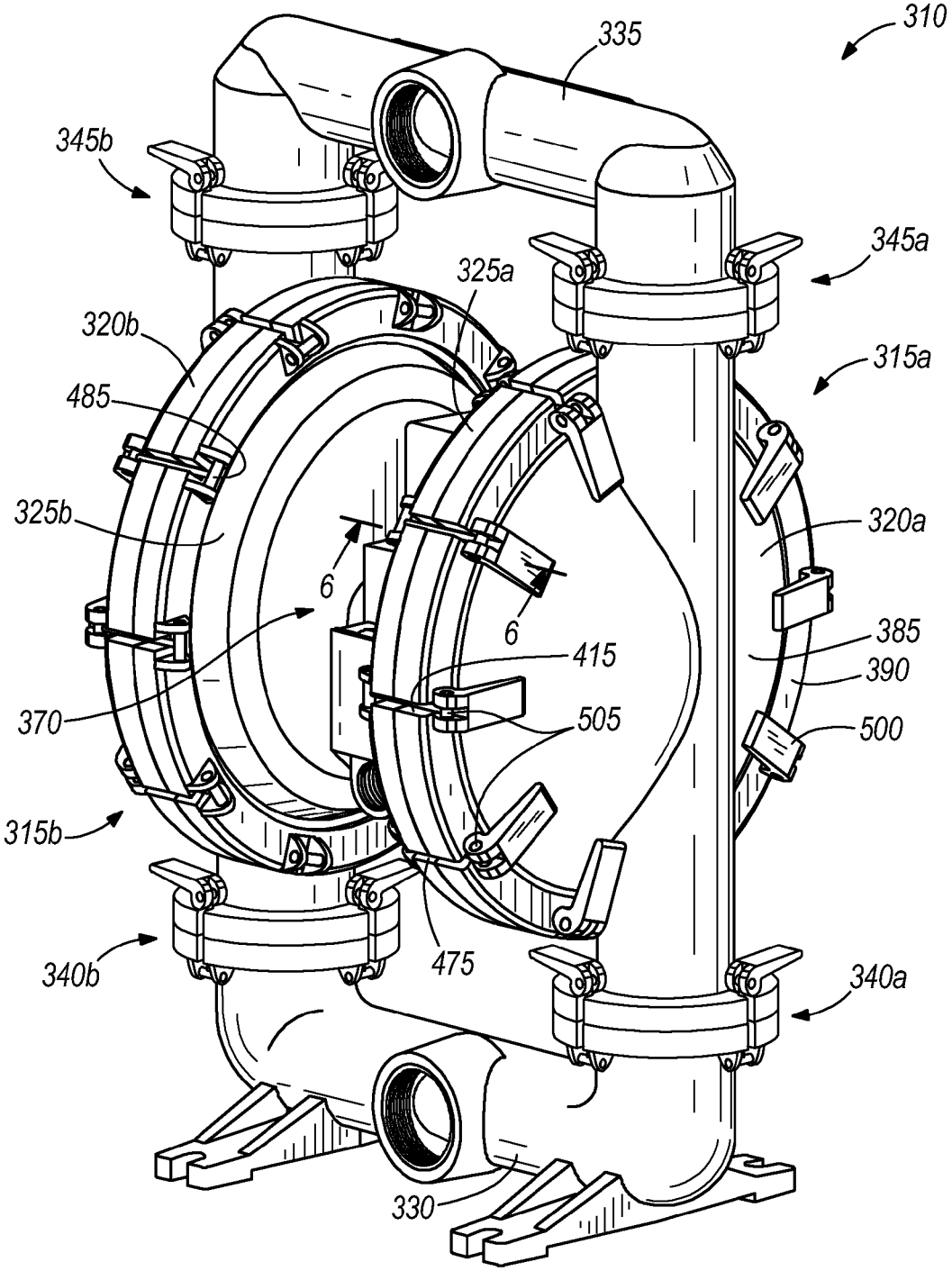
FIG. 5 is a perspective view of a double-diaphragm pump having a second clamp embodiment.
Figure 6:
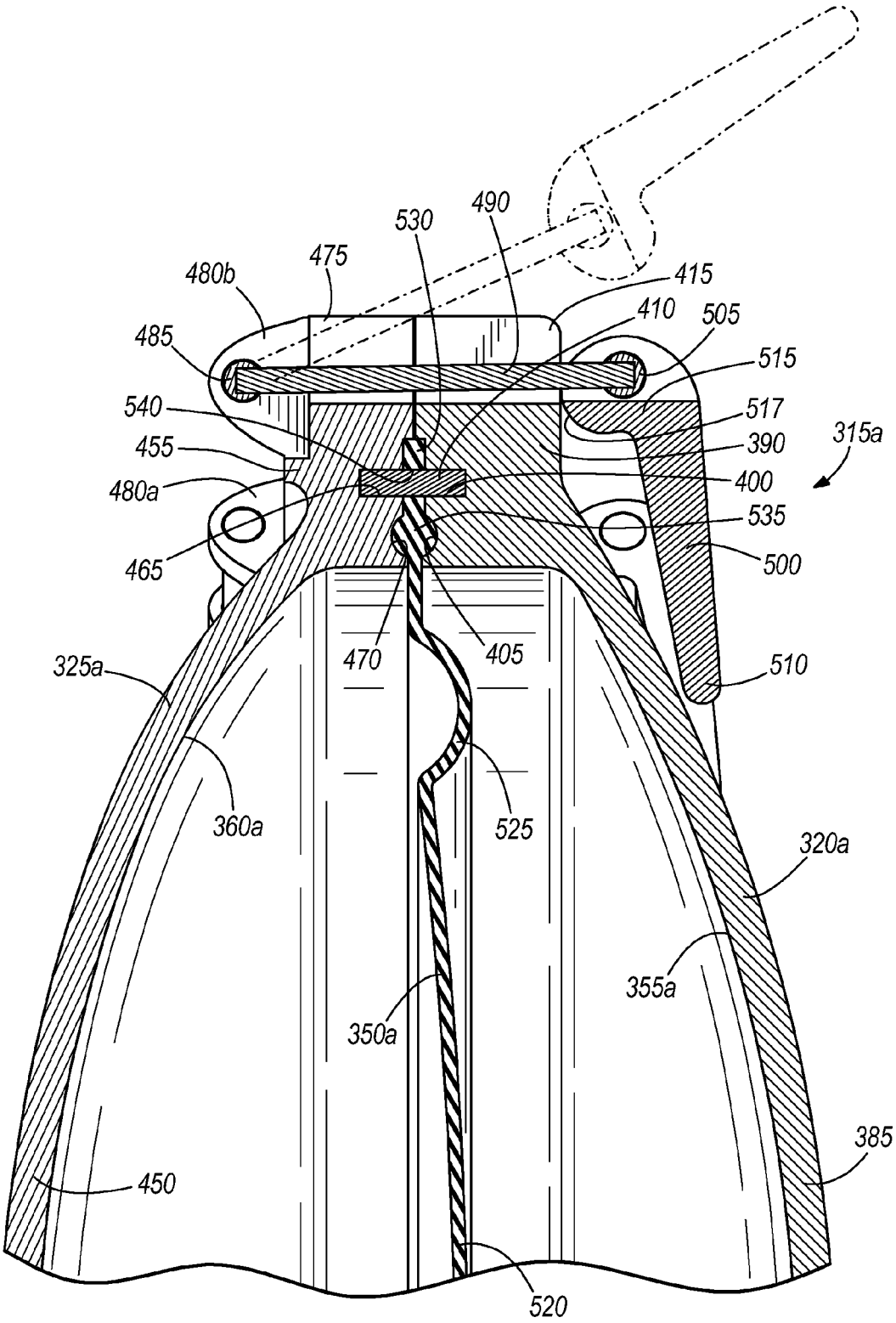
FIG. 6 is a cross-sectional view of the clamp of FIG. 5 in an engaged position, taken along line 6-6 of FIG. 5.
Figure 7:
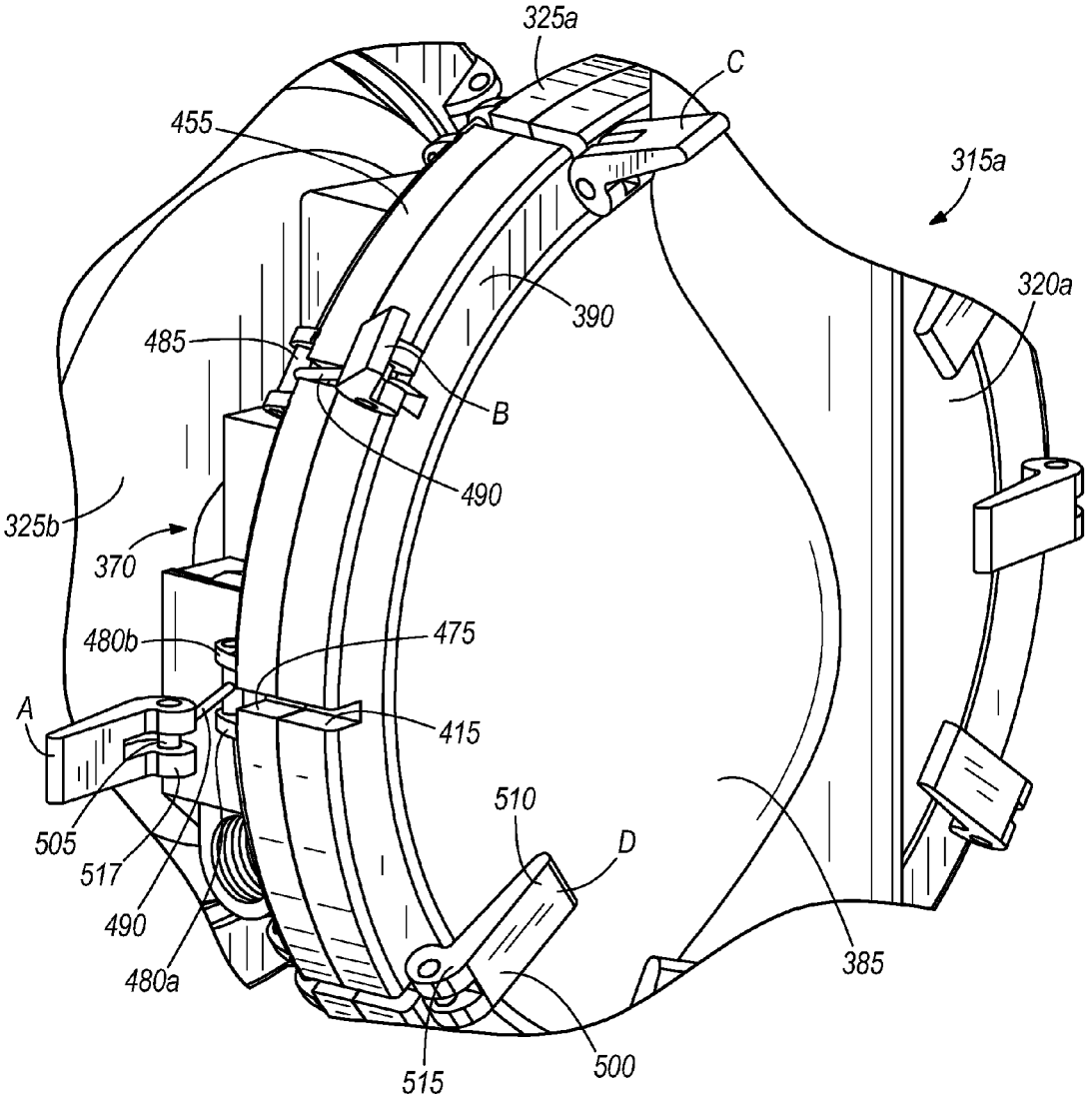
FIG. 7 is a perspective view of the clamp of FIGS. 5 and 6 shown in a variety of disengaged, engaged and partially engaged positions.

Another embodiment of a double diaphragm pump 310 according to the present invention is illustrated in FIGS. 5-7. The pump 310 has a housing defining two working chambers 315*a*, 315*b*. In other embodiments, the prime mover may be another type of double-diaphragm pump, a piston pump, a motor or any other machinery having a reciprocating or moving part to be monitored. The working chambers 315*a*, 315*b* are defined by respective fluid caps 320*a*, 320*b* and air caps 325*a*, 325*b*. The pump 310 includes an inlet manifold 330 and an outlet manifold 335. The inlet manifold 330 is fluidly coupled to an inlet 340*a* of the working chamber 315*a* and is fluidly coupled to an inlet 340*b* of the working chamber 315*b*. The outlet manifold 335 is fluidly coupled to an outlet 345*a* of the working chamber 315*a* and is fluidly coupled to an outlet 345*b* of the working chamber 315*b*.

Working chamber 315*a* is shown in greater detail in FIGS. 6 and 7. Working chamber 315*b* is a substantial mirror image of working chamber 315*a*. Therefore, only the working chamber 315*a* will be described in detail, as the disclosure of working chamber 315*a* also applies to working chamber 315*b*. The working chamber 315*a* is divided with a flexible diaphragm 350*a* into a pumping chamber 355*a* and a motive fluid chamber 360*a*.

The pump 310 further includes a valve 370 moveable between first and second positions which controls operation of the pump 310. Operation of the pump 310 is substantially identical to operation of the pump 10, and therefore, reference is made to the description of the operation of the pump 10 above.

The fluid cap 320*a* is a substantially circular plate 385 having a peripheral flange 390 extending radially outwardly therefrom. The substantially circular plate 385 and the diaphragm 350*a* define the working chamber 315*a*. The peripheral flange 390 defines first and second pluralities of bores 400, 405 (one of each of which is illustrated in FIG. 6). The first plurality of bores 400 are substantially cylindrical and the second plurality of bores 405 are substantially spherical. In the illustrated embodiment, a pin 410 is positioned within each of the first plurality of bores 400 and extends outwardly therefrom. The peripheral flange 390 further defines a plurality of axial slots 415 extending therethrough.

The air cap 325*a* is a substantially circular plate 450 having a peripheral flange 455 extending radially outwardly therefrom. The substantially circular arcuate plate 450 and the diaphragm 350*a* define the motive fluid chamber 360*a*. The peripheral flange 455 defines first and second pluralities of bores 465, 470 (one of each of which is illustrated in FIG. 6). The first plurality of bores 465 are substantially cylindrical and the second plurality of bores 470 are substantially spherical. In the illustrated embodiment, the first plurality of bores 465 are sized to receive a portion of the pin 410.

The peripheral flange 455 further defines a plurality of axial slots 475 extending therethrough. The peripheral flange 455 additionally defines a plurality of pairs of ribs 480*a*, 480*b* extending axially therefrom. One of the pairs of ribs 480*a* is positioned on a first side of each axial slot 475 and the other of the pairs of ribs 480*b* is positioned on a second side of each axial slot 475. Each of the respective pairs of ribs 480*a*, 480*b* has a pin 485 extending therebetween.

Each of the pins 485 supports a respective rod 490 for rotation about the pin 485. The rods 490 are rotatable with respect to the ribs 480*a*, 480*b* to a first orientation in which the rods 490 are positioned within the axial slots 415, 475 (shown in solid in FIG. 6). The rods 490 are rotatable with respect to the ribs 480*a*, 480*b* to a second orientation in which the rods 490 are removed from at least axial slot 415 (shown in phantom in FIG. 6) and optionally additionally removed from axial slot 475 (shown in FIG. 7).

A respective cam clamp 500 is coupled to each of the plurality of rods 490 for rotation with respect to the rods 490 about a pin 505. Each cam clamp 500 is rotatable between a first position (shown in solid in FIG. 6) and a second position (shown in phantom in FIG. 6). Each cam clamp 500 includes a clamp handle 510 and a cam end 515. The cam end 515 defines a cam surface 517 of increasing radial distance from the pin 505.

The diaphragm 350*a* includes a substantially circular plate 520, a circumferential projection 525 which permits the diaphragm 350*a* to have flexibility to move toward the fluid cap 320*a* or toward the air cap 325*a*. The diaphragm 350*a* further includes a peripheral flange 530 extending axially outward from the circumferential projection 525.

The peripheral flange 530 includes a circumferential protrusion 535 that has a substantially circular cross-section. The bores 405 and 470 are sized to receive the circumferential protrusion 535 therein. The peripheral flange 530 also defines a plurality of apertures 540. The plurality of apertures 540 are each sized to receive a respective one of the pins 410 therethrough.

FIG. 7 illustrates rods 490 and cam clamps 500 in various locked and unlocked positions. Specifically, in position A, the rod 490 is removed from axial slots 415 and 475 and the cam clamp 500 is in the second, unlocked position. In position B, the rod 490 is removed from axial slot 415, but extends through a portion of axial slot 475, and the cam clamp 500 is in the second, unlocked position. Position B is similar to the second position shown in phantom in FIG. 6. In position C, the rod 490 extends through axial slots 415 and 475 and the cam clamp 500 is in the second, unlocked position. In position D, the rod 490 extends through axial slots 415 and 475 and the cam clamp 500 is in the first, locked position. Position D is similar to the first position shown in solid in FIG. 6.

In order to assemble the working chamber 315*a*, the rods 490 and the cam clamps 500 are rotated to either position A or position B. Then, the diaphragm 350*a* is coupled to the fluid cap 320*a* by inserting the pins 410 through the respective apertures 540 and into the respective bores 400. The air cap 325*a* is coupled to the diaphragm 350*a* and the fluid cap 520*a* by inserting the pins 410 into the respective bores 465. The circumferential protrusion 535 is received within the bores 405 and 470. The rods 490 are then rotated from either position A or position B into position C, such that the rod 490 extends through axial slots 415 and 475. Then, the cam clamps 500 are rotated from the second, unlocked position (see Position C) into the first, locked position (see Position D). When in Position D, the diaphragm 350*a* is compressed between the fluid cap 320*a* and the air cap 325*a*, to make the pump chamber 355*a* and the working fluid chamber 360*a*, respectively substantially fluid-tight.

The cam surface 517 presses against the peripheral flange 390 with increasing force as the cam clamp 500 is rotated from the unlocked position (see Position C) to the locked position (see Position D). The cam clamp 500 is in an over-center position in the locked position (see Position D), which is self-energizing to bias the cam clamp 500 to stay in the locked position.

The pump 310 can be assembled without the use of tools, because an operator can rotate rods 490 about the respective pins 485 and rotate the cam clamps 500 about the respective pins 505 to secure the fluid caps 320*a*, 320*b* to the respective air caps 325*a*, 325*b*. In another embodiment, the rods 490 and the cam clamps 130 are coupled to ribs on the fluid caps 320*a*, 320*b*, such that the cam ends 515 engage the respective air caps 325*a*, 325*b*.

As shown in FIG. 5, the inlet manifold 330 and the outlet manifold 335 are similarly coupleable to the inlets 340*a*, 340*b* and the outlets 345*a*, 345*b*, respectively by rods 490 and cam clamps 500. The inlet manifold 330 and outlet manifold 335 are coupleable to the inlets 340*a*, 340*b* and the outlets 345*a*, 345*b*, respectively, without the use of tools.

Another embodiment of a double diaphragm pump 610 according to the present invention is illustrated in FIGS. 8-11. The pump 610 has a housing defining two working chambers 615*a*, 615*b*. In other embodiments, the prime mover may be another type of double-diaphragm pump, a piston pump, a motor or any other machinery having a reciprocating or moving part to be monitored. The working chambers 615*a*, 615*b* are defined by respective fluid caps, such as 620*a* illustrated in FIG. 8 and air caps 625*a*, 625*b* illustrated in FIGS. 11 and 8 respectively. The pump 610 includes an inlet manifold 630 and an outlet manifold 635. The inlet manifold 630 is fluidly coupled to an inlet 640*a* of the working chamber 615*a* and is fluidly coupled to an inlet 640*b* of the working chamber 615*b*. The outlet manifold 635 is fluidly coupled to an outlet 645*a* of the working chamber 615*a* and is fluidly coupled to an outlet 645*b* of the working chamber 615*b*. Operation of the pump 610 is substantially identical to operation of the pump 10, and therefore, reference is made to the description of the operation of the pump 10 above.

Figure 9:
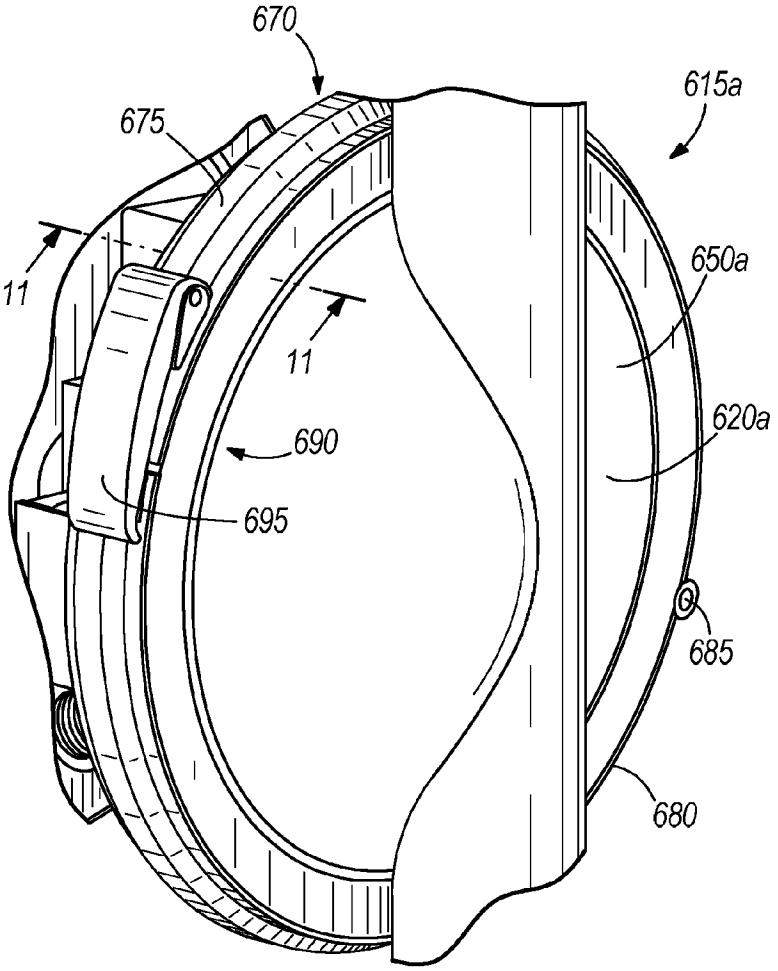
FIG. 9 is a close-up view of the clamp of FIG. 8 in an engaged position.
Figure 10:
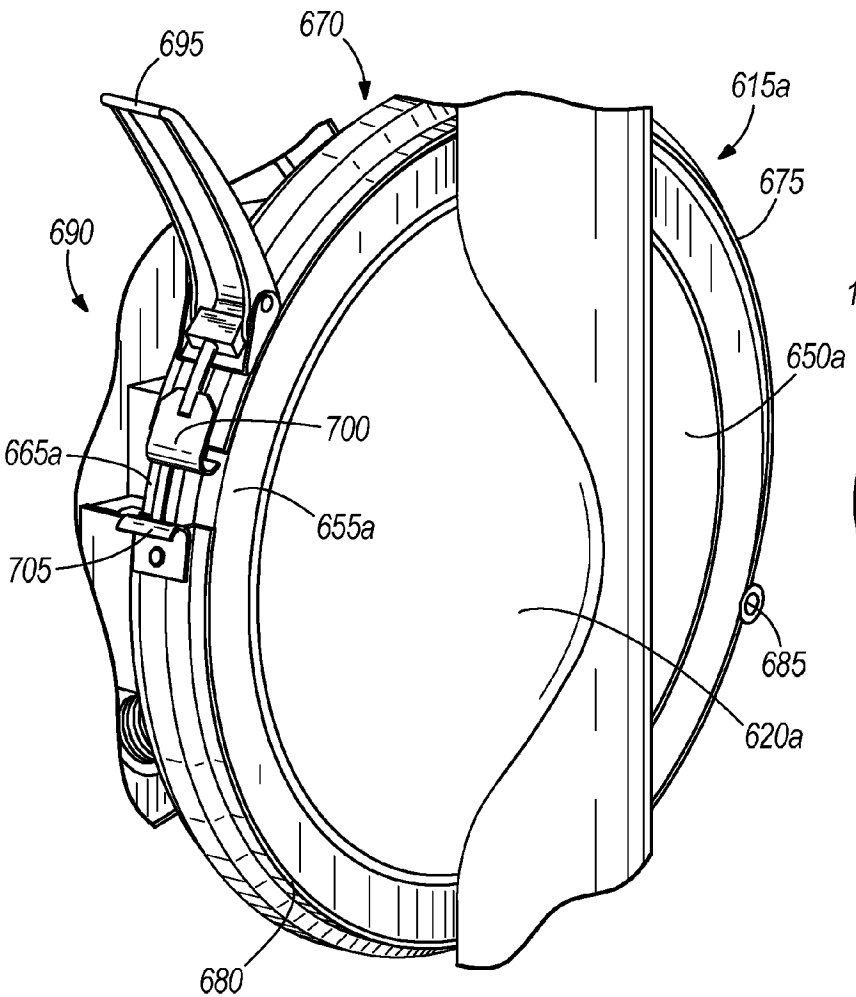
FIG. 10 is a close-up view of the clamp of FIG. 8 in a disengaged position.
Figure 11:
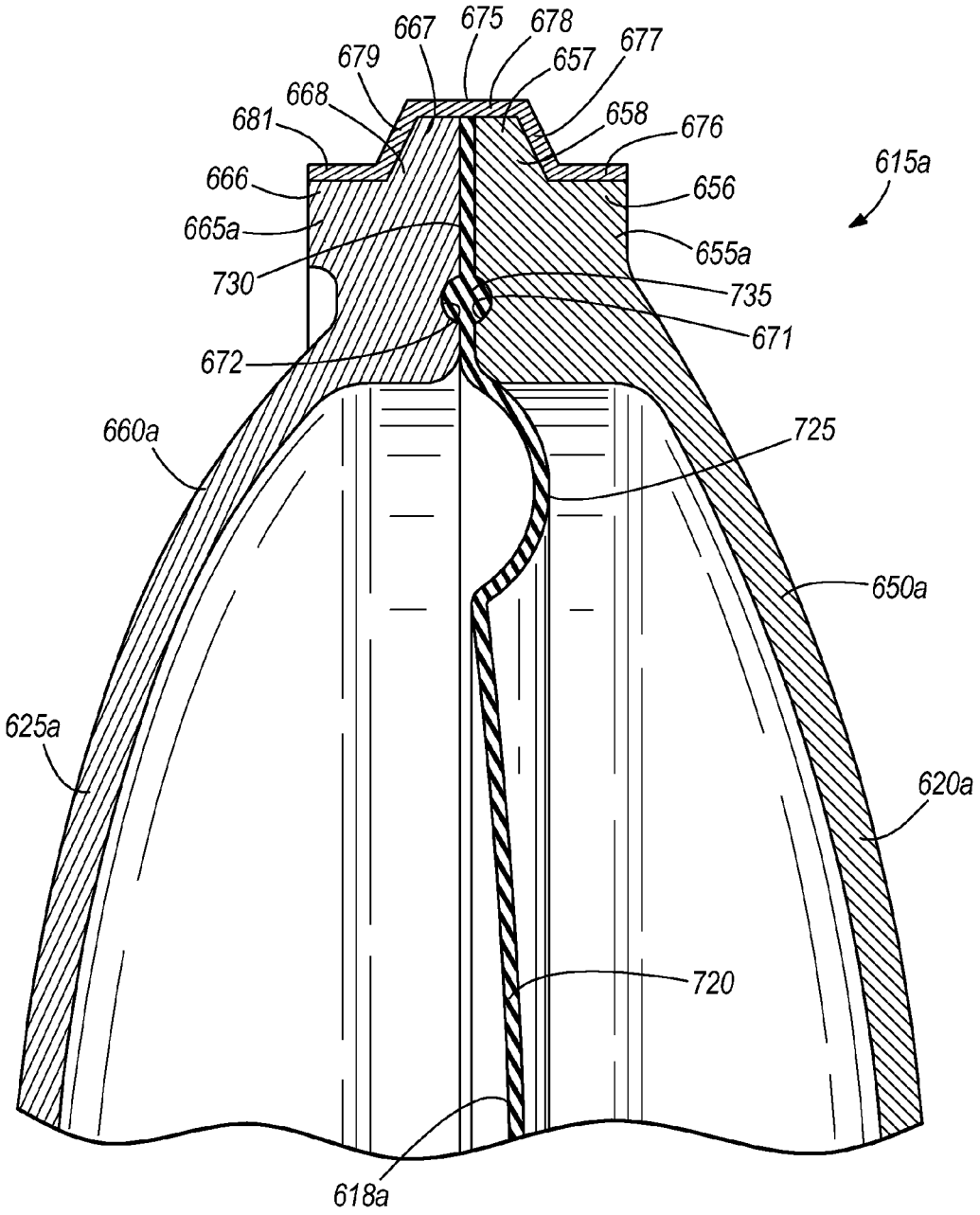
FIG. 11 is a cross sectional view of the clamp taken along line 11-11 of FIG. 9.

Working chamber 615*a* is shown in greater detail in FIGS. 9-11. Working chamber 615*b* is a substantial mirror image of working chamber 615*a*. Therefore, only the working chamber 615*a* will be described in detail, as the disclosure of working chamber 615*a* also applies to working chamber 615*b*. The working chamber 615*a* is divided with a flexible diaphragm 618*a* into a pumping chamber and a motive fluid chamber, as described above with respect to working chambers 15*a* and 315*a*.

The fluid cap 620*a* is a substantially circular plate 650*a* having a peripheral flange 655*a* extending radially outwardly therefrom. The air cap 625*a* is a substantially circular plate 660*a* having a peripheral flange 665*a* extending radially outwardly therefrom.

With reference to FIG. 11, the peripheral flange 655*a* includes a first recessed portion 656, a first protruding portion 657, and a first tapered portion 658. The first recessed portion 656 has a smaller perimeter than the first protruding portion 657 and the first tapered portion 658 transitions between the first recessed portion 656 and the first protruding portion 657. Similarly, the peripheral flange 665*a* includes a second recessed portion 666, a second protruding portion 667, and a second tapered portion 668. The second recessed portion 666 has a smaller perimeter than the second protruding portion 667 and the second tapered portion 668 transitions between the second recessed portion 666 and the second protruding portion 667. In the illustrated embodiment, the peripheral flange 655*a* is substantially a mirror image of the peripheral flange 665*a*. As shown in FIG. 11, the first and second protruding portions 657, 667 are positioned adjacent one another, whereas the first and second recessed portions 656, 666 are spaced apart from one another. The peripheral flange 655*a* defines a first blind bore 671 that is substantially spherical and the peripheral flange 665*a* defines a second blind bore 671 that is substantially spherical.

Figure 8:
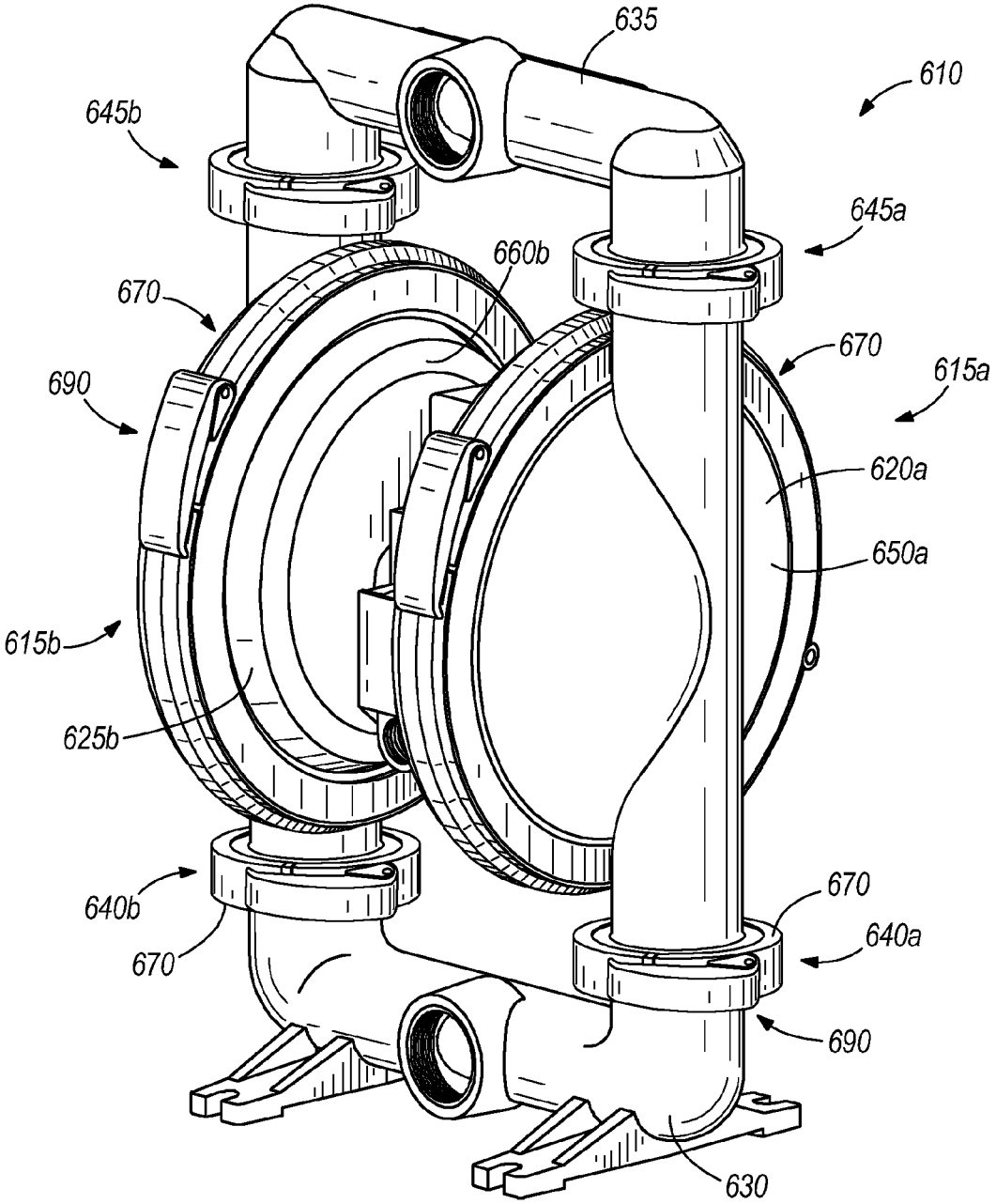
FIG. 8 is a perspective view of a double-diaphragm pump having a third clamp embodiment.

As shown in FIGS. 8-10, a hinged clamp 670 includes a first clamp portion 675, a second clamp portion 680, and a hinge 685 coupled to the first and second clamp portions 675, 680, such that the first clamp portion 675 is moveable with respect to the second clamp portion 680. The first and second clamp portions 675, 680 define substantially identical cross-sections. Only the cross-section of clamp portion 675 will be discussed in detail, but clamp portion 680 is substantially a mirror-image of clamp portion 675. With continued reference to FIG. 11, the clamp portion 675 includes a first recessed portion 676, a first tapered portion 677, a protruding portion 678, a second tapered portion 679, and a second recessed portion 681. The first tapered portion 677 is substantially a mirror-image of the second tapered portion 679. The cross-section of the clamp portions 675, 680 are shaped to engage the cross-sections of the peripheral flanges 655*a*, 665*a*. In some embodiments, the protruding portion 678 is spaced from the first and second protruding portions 657, 667 to permit the first and second tapered portions 677, 679 to firmly compress the first and second protruding portions 657, 667 against the diaphragm 618*a*.

An over-center latch 690 is coupled to the first clamp portion 675. The over-center latch 690 includes a handle 695 and a first hook 700. A second hook 705 is coupled to the second clamp portion 680. The handle 695 is moveable between a first, locked position, shown in FIG. 9 and a second, unlocked position, shown in FIG. 10. Movement toward the locked position initially moves the first hook 700 toward and past the second hook 705. Continued movement of first hook 700 draws the first hook 700 back, into engagement with the second hook 705. When in the locked position, the first hook 700 engages the second hook 705 to compress the diaphragm 618*a* between the fluid cap 620*a* and the air cap 625*a*, to make the pump chamber and the working fluid chamber substantially fluid-tight.

As shown in FIG. 11, the diaphragm 618*a* includes a substantially circular plate 720, a circumferential projection 725 which permits the diaphragm 618*a* to have flexibility to move toward the fluid cap 620*a* or toward the air cap 625*a*. The diaphragm 618*a* further includes a peripheral flange 730 extending axially outward from the circumferential projection 725. The peripheral flange 730 includes a circumferential protrusion 735 that has a substantially circular cross-section. The peripheral flange 730 is positioned between the first protruding portion 657 and the second protruding portion 667. The circumferential protrusion 735 is received in the first and second blind bores 671, 672.

The pump 610 can be assembled without the use of tools, because an operator can rotate the handle 695 of the over-center latch 690 to secure the working chamber 615*a*, 615*b* of the pump 610. When the latch 690 is moved to the locked position (see FIGS. 8, 9 and 11), the first and second tapered portions 677 and 679 of the first clamp portion 675 (in addition to tapered portions of the second clamp portion 680) bear against the first tapered portion 658 of the fluid cap 620*a* and the second tapered portion 667 of the air cap 625*a* to thereby bias the fluid cap 620*a* and the air cap 625*a* into engagement with the peripheral flange 730 of the diaphragm 618*a*. In another embodiment, the over-center latch 690 is coupled to the second clamp portion 680 and the second hook 705 is coupled to the first clamp portion 675. The latch 690 is in an over-center position in FIGS. 8 and 9, which is self-energizing to bias the latch 690 to stay in the locked position.

As shown in FIG. 8, the inlet manifold 630 and the outlet manifold 635 are similarly coupleable to the inlets 640*a*, 640*b* and the outlets 645*a*, 645*b*, respectively by hinged clamps 670. The inlet manifold 630 and outlet manifold 635 are coupleable to the inlets 640*a*, 640*b* and the outlets 645*a*, 645*b*, respectively, without the use of tools. Although not specifically shown in FIG. 8, the hinged clamps 670 on the inlets 640*a*, 640*b* and the outlets 645*a*, 645*b* can include one or more tapered portions.

Another embodiment of a double diaphragm pump 810 according to the present invention is illustrated in FIGS. 12-15. The pump 810 has a housing defining two working chambers 815*a*, 815*b*. In other embodiments, the prime mover may be another type of double-diaphragm pump, a piston pump, a motor or any other machinery having a reciprocating or moving part to be monitored. The working chambers 815*a*, 815*b* are defined by respective fluid caps, such as 820*a* illustrated in FIGS. 12 and 15 and air caps 825*a*, 825*b* illustrated in FIGS. 15 and 12 respectively. The pump 810 includes an inlet manifold 830 and an outlet manifold 835. The inlet manifold 830 is fluidly coupled to an inlet 840*a* of the working chamber 815*a* and is fluidly coupled to an inlet 840*b* of the working chamber 815*b*. The outlet manifold 835 is fluidly coupled to an outlet 845*a* of the working chamber 815*a* and is fluidly coupled to an outlet 845*b* of the working chamber 815*b*. Operation of the pump 810 is substantially identical to operation of the pump 10, and therefore, reference is made to the description of the operation of the pump 10 above.

Figure 13:
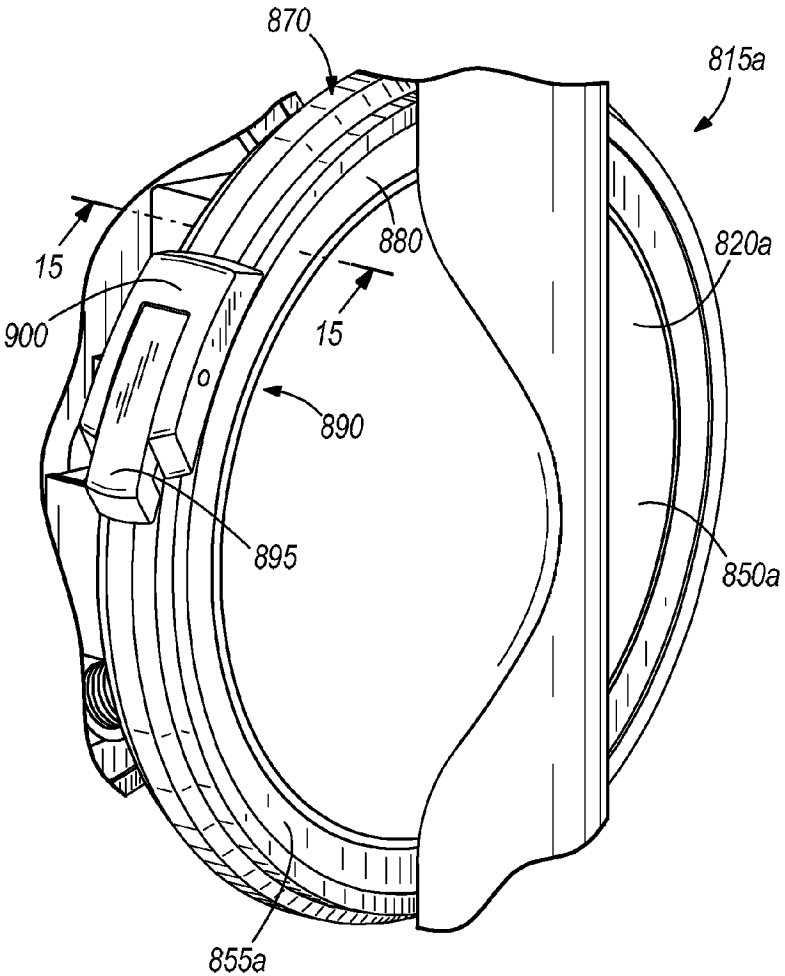
FIG. 13 is a close-up view of the clamp of FIG. 12 in an engaged position.
Figure 14:
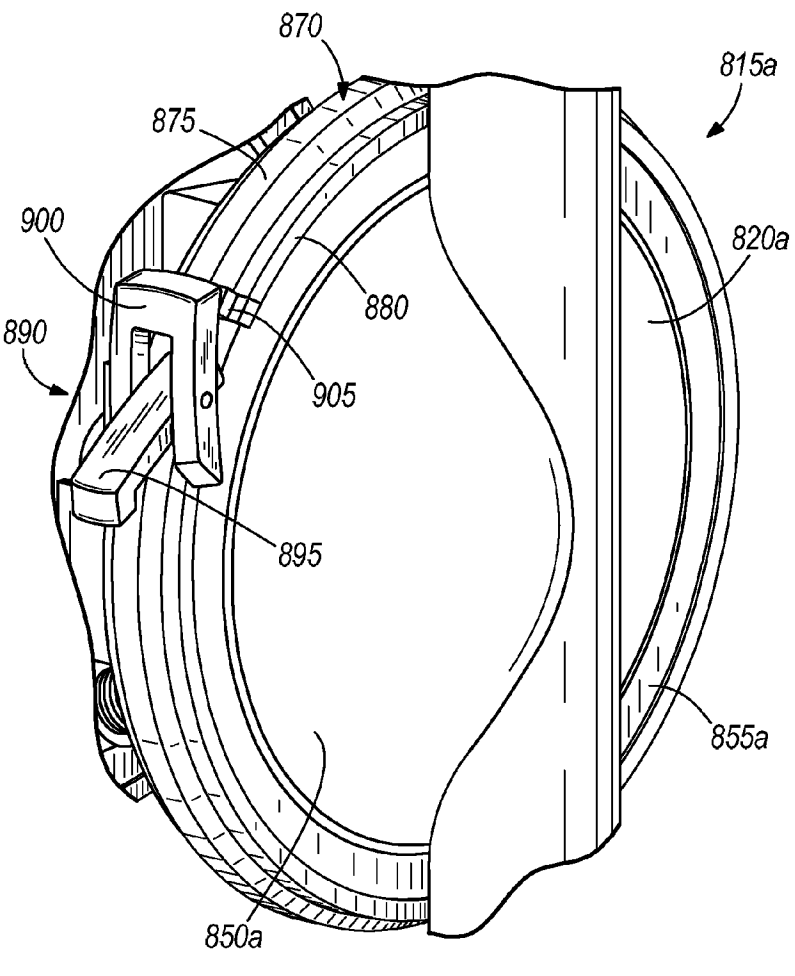
FIG. 14 is a close-up view of the clamp of FIG. 12 in a disengaged position.
Figure 15:
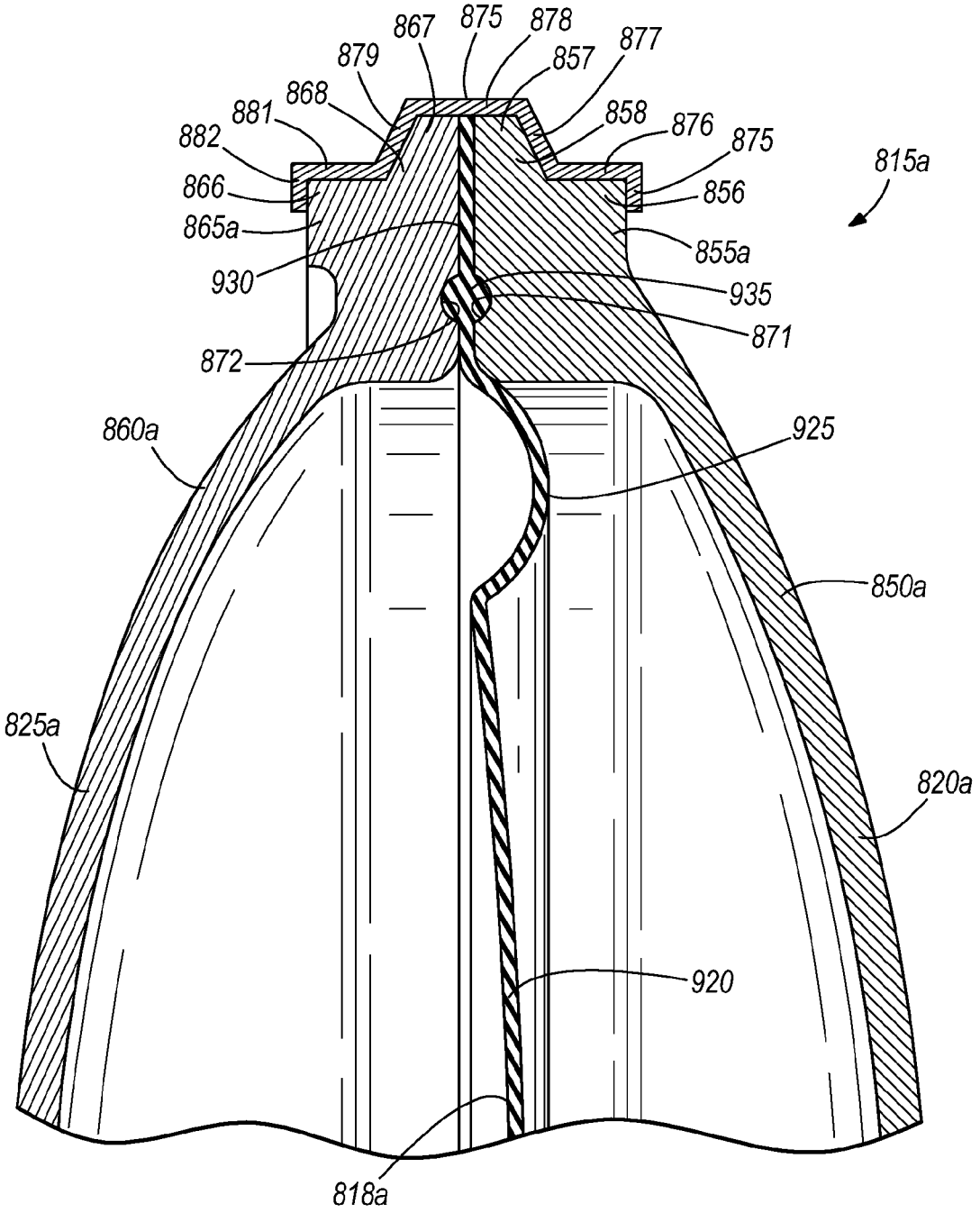
FIG. 15 is a cross sectional view of the clamp taken along line 15-15 of FIG. 13.

Working chamber 815*a* is shown in greater detail in FIGS. 13-15. Working chamber 815*b* is a substantial mirror image of working chamber 815*a*. Therefore, only the working chamber 815*a* will be described in detail, as the disclosure of working chamber 815*a* also applies to working chamber 815*b*. The working chamber 815*a* is divided with a flexible diaphragm 818*a* into a pumping chamber and a motive fluid chamber, as described above with respect to working chambers 15*a*, 315*a*, and 615*a*.

The fluid cap 820*a* is a substantially circular plate 850*a* having a peripheral flange 855*a* extending radially outwardly therefrom. The air cap 825*a* is a substantially circular plate 860*a* having a peripheral flange 865*a* extending radially outwardly therefrom.

With reference to FIG. 15, the peripheral flange 855*a* includes a first recessed portion 856, a first protruding portion 857, and a first tapered portion 858. The first recessed portion 856 has a smaller perimeter than the first protruding portion 857, and the first tapered portion 858 transitions between the first recessed portion 856 and the first protruding portion 857. Similarly, the peripheral flange 865*a* includes a second recessed portion 866, a second protruding portion 867, and a second tapered portion 868. The second recessed portion 866 has a smaller perimeter than the second protruding portion 867, and the second tapered portion 868 transitions between the second recessed portion 866 and the second protruding portion 867. In the illustrated embodiment, the peripheral flange 855*a* is substantially a mirror image of the peripheral flange 865*a*. As shown in FIG. 15, the first and second protruding portions 857, 867 are positioned adjacent one another, whereas the first and second recessed portions 856, 866 are spaced apart from one another. The peripheral flange 855*a* defines a first blind bore 871 that is substantially spherical and the peripheral flange 865*a* defines a second blind bore 871 that is substantially spherical.

A band clamp 870 includes a first depending flange 875, a first recessed portion 876, a first tapered portion 877, a protruding portion 878, a second tapered portion 879, a second recessed portion 881 and a second depending flange 882. The first depending flange 875 engages the fluid cap 820*a* and the second depending flange 882 engages the air cap 825*a*. The first tapered portion 877 is substantially a mirror-image of the second tapered portion 879. The cross-section of the band clamp 870 is shaped to engage the cross-sections of the peripheral flanges 855*a*, 865*a*. In some embodiments, the protruding portion 878 is spaced from the first and second protruding portions 857, 867 to permit the first and second tapered portions 877, 879 to firmly compress the first and second protruding portions 857, 867 against the diaphragm 818*a*.

An over-center latch 890 is coupled to a first end of the band clamp 870. The over-center latch 890 includes a handle 895 and a first hook 900. A second hook 905 is coupled to a second end of the band clamp 870. The handle 895 is moveable between a first, locked position, shown in FIGS. 12 and 13, and a second, unlocked position, shown in FIG. 14. Movement toward the locked position initially moves the first hook 900 toward and past the second hook 905. Continued movement of first hook 900 draws the first hook 900 back, into engagement with the second hook 905. When in the locked position, the first hook 900 engages the second hook 905 to compress the diaphragm between the fluid cap 820*a* and the air cap 825*a*, to make the pump chamber and the working fluid chamber substantially fluid-tight.

As shown in FIG. 15, the diaphragm 818*a* includes a substantially circular plate 920, a circumferential projection 925 which permits the diaphragm 818*a* to have flexibility to move toward the fluid cap 820*a* or toward the air cap 825*a*. The diaphragm 818*a* further includes a peripheral flange 930 extending axially outward from the circumferential projection 925. The peripheral flange 930 includes a circumferential protrusion 935 that has a substantially circular cross-section. The peripheral flange 930 is positioned between the first protruding portion 857 and the second protruding portion 867. The circumferential protrusion 935 is received in the first and second blind bores 971, 972.

The pump 810 can be assembled without the use of tools, because an operator can rotate the handle 895 of the over-center latch 890 to secure the working chamber 815*a*, 815*b* of the pump 810. When the latch 890 is moved to the locked position (see FIGS. 12 and 13), the first and second tapered portions 877 and 879 of the band clamp 870 bear against the first tapered portion 858 of the fluid cap 820*a* and the second tapered portion 868 of the air cap 825*a*, to thereby bias the fluid cap 820*a* and the air cap 825*a* into engagement with the peripheral flange 930 of the diaphragm 818*a*. The latch 890 is in an over-center position in FIGS. 12 and 13, which is self-energizing to bias the latch 890 to stay in the locked position.

Figure 12:
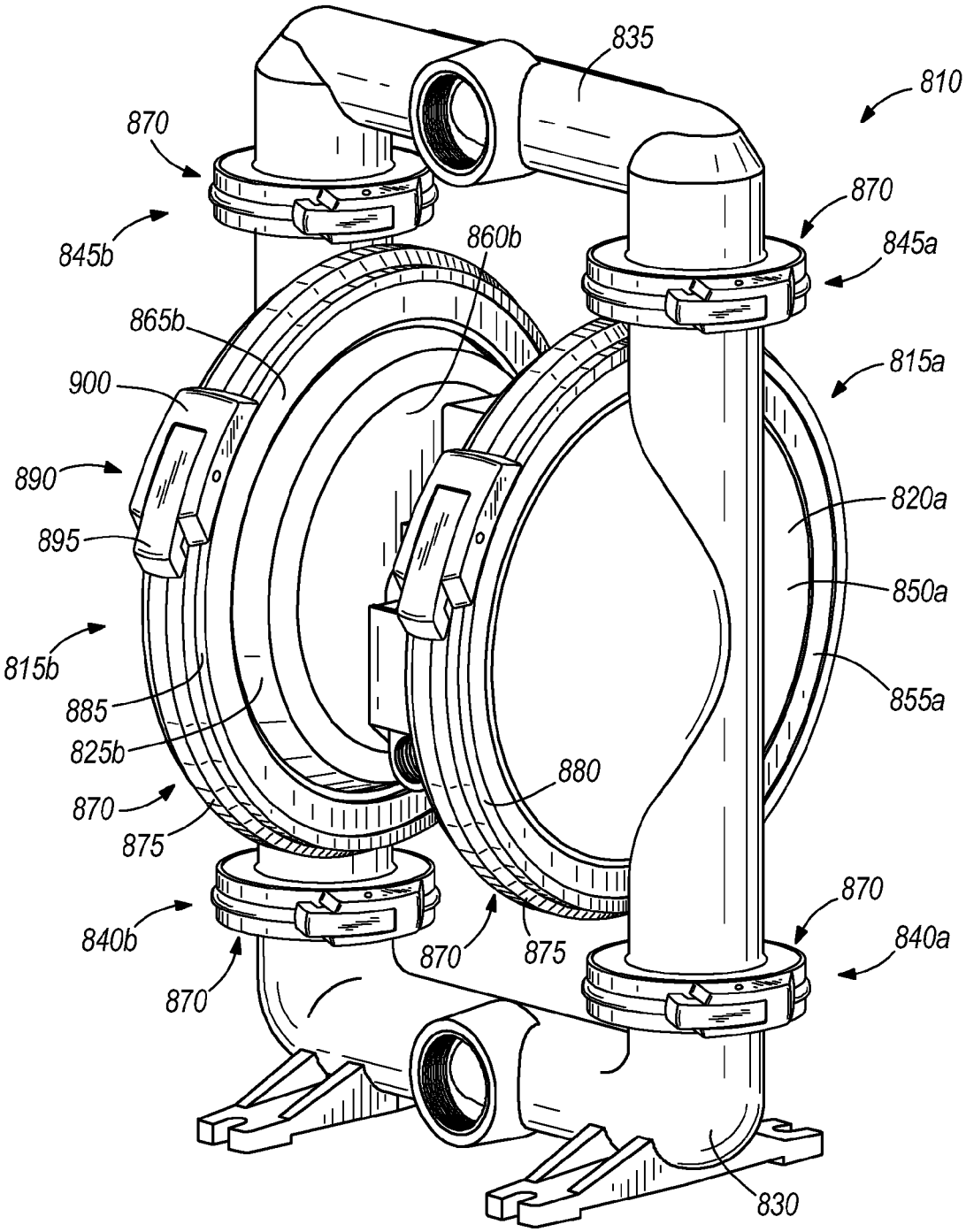
FIG. 12 is a perspective view of a double-diaphragm pump having a fourth clamp embodiment.

As shown in FIG. 12, the inlet manifold 830 and the outlet manifold 835 are similarly coupleable to the inlets 840*a*, 840*b* and the outlets 845*a*, 845*b*, respectively by band clamps 870. The inlet manifold 830 and outlet manifold 835 are coupleable to the inlets 840*a*, 840*b* and the outlets 845*a*, 845*b*, respectively, without the use of tools. Although not specifically shown in FIG. 12, the band clamps 870 of the inlets 840*a*, 840*b* and the outlets 845*a*, 845*b* can include one or more tapered portions.

The overlap of the embodiments of FIGS. 1-7 and the taper(s) of the embodiments of FIGS. 8-15 are included to assure that the pumps are operable under suitable pressures while being held together by clamps. Previously, it has not been possible to replace the usual fasteners, such as bolts, with clamps because such a replacement has not previously resulted in a functional and useable pump. However, the unique overlap and tapered configurations permit the pumps to function at suitable pressures and under suitable loads.

Various features and advantages of the invention are set forth in the following claims.

What is claimed is:

1. A diaphragm pump comprising:
- a first plate;
- a second plate;
- a diaphragm having first and second oppositely facing sides;
- a fluid chamber defined by the first plate and the first side of the diaphragm;
- a fluid inlet fluidly coupled to the fluid chamber;
- a fluid outlet fluidly coupled to the fluid chamber;
- an air chamber defined between the second plate and the second side of the diaphragm, wherein the diaphragm is retained between the first plate and the second plate;
- a first clamp moveable between a first position in which the first clamp fixedly couples the first plate, the second plate and the diaphragm, and a second position in which the first clamp uncouples the first plate, the second plate and the diaphragm to permit disassembly of the first plate, the second plate and the diaphragm; and
- wherein the diaphragm includes a circumferential flange portion trapped between the first and second plates, the flange portion having an aperture, the pump further comprising a pin extending through the aperture in the diaphragm flange portion and received in each of the first and second plates, the pin fixedly coupling the diaphragm between the first plate and the second plate.

2. The pump of claim 1, wherein the first clamp is a cam clamp and wherein a portion of the first plate overlaps a portion of the second plate around at least a portion of a perimeter of the first plate.

3. The pump of claim 1, wherein the first clamp is pivotably mounted on one of the first and second plates, the pump further comprises a groove defined in an outer perimeter of the other of the first plate and the second plate, and wherein the first clamp includes a cam that engages the groove in the first position and is removed from the groove in the second position.

4. The pump of claim 1, further comprising a plurality of the first clamps disposed around a perimeter of the first and second plates.

5. The pump of claim 1, further comprising a second clamp and an inlet pipe, the second clamp fixedly coupling the fluid inlet to the inlet pipe.

6. The pump of claim 5, further comprising a third clamp and an outlet pipe, the third clamp fixedly coupling the fluid outlet to the outlet pipe.

7. The pump of claim 1, further comprising a rib on the diaphragm and a groove in at least one of the first and second plates, such that the rib engages the groove to sealingly couple the diaphragm to the one of the first and second plates.

8. The pump of claim 1, further comprising a hinged clamp substantially encircling a perimeter of the first and second plates, the first clamp coupled to the hinged clamp to clamp the diaphragm between the first and second plates, wherein the first clamp is an over-center latch, wherein at least one of the hinged clamp, the first plate and the second plate includes a taper, and wherein the taper biases at least one of the first and second plates against the diaphragm.

9. The pump of claim 8, further comprising a second clamp and an inlet pipe, the second clamp fixedly coupling the fluid inlet to the inlet pipe, wherein the second clamp is an over-center latch.

10. The pump of claim 1, further comprising a band clamp substantially encircling a perimeter of the first and second plates, the first clamp coupled to the band clamp to clamp the diaphragm between the first and second plates, wherein the first clamp is an over-center latch, wherein at least one of the band clamp, the first plate and the second plate includes a taper, and wherein the taper biases at least one of the first and second plates against the diaphragm.

11. The pump of claim 10, further comprising a second clamp and an inlet pipe, the second clamp fixedly coupling the fluid inlet to the inlet pipe, wherein the second clamp is an over center latch.

12. The pump of claim 11, further comprising a third clamp and an outlet pipe, the third clamp fixedly coupling the fluid outlet to the outlet pipe.

13. The pump of claim 12, wherein the third clamp is an over-center latch.

14. The pump of claim 1, wherein the first clamp is operable by hand, without requiring the use of tools.

15. The diaphragm pump of claim 1, wherein the first clamp is an over-center latch, wherein at least one of the first plate and the second plate includes a taper, and wherein the taper biases at least one of the first and second plates against the diaphragm.

16. The diaphragm pump of claim 1, wherein the first clamp is operable by hand, without requiring the use of tools.

17. A diaphragm pump comprising:

a first plate;

a second plate;

a diaphragm having first and second oppositely facing sides;

a fluid chamber defined by the first plate and the first side of the diaphragm;

a fluid inlet fluidly coupled to the fluid chamber;

a fluid outlet fluidly coupled to the fluid chamber;

an air chamber defined between the second plate and the second side of the diaphragm, wherein the diaphragm is retained between the first plate and the second plate;

a first clamp moveable between a first position in which the first clamp fixedly couples the first plate, the second plate and the diaphragm, and a second position in which the first clamp uncouples the first plate, the second plate and the diaphragm to permit disassembly of the first plate, the second plate and the diaphragm;

a groove defined in an outer perimeter of the other of the first plate and the second plate, such that the first clamp engages the groove in the first position and is removed from the groove in the second position;

a second clamp and an inlet pipe, wherein the second clamp fixedly couples the fluid inlet to the inlet pipe, wherein the second clamp is moveable between a first position in which second clamp fixedly couples fluid inlet to the inlet pipe, and a second position in which the second clamp uncouples the fluid inlet and the inlet pipe to permit disassembly of the fluid inlet and the inlet pipe;

a third clamp and an outlet pipe, wherein the third clamp fixedly couples the fluid outlet to the outlet pipe, wherein the third clamp is moveable between a first position in which third clamp fixedly couples the fluid outlet and the outlet pipe, and a second position in which the third clamp uncouples the fluid outlet and the outlet pipe to permit disassembly of the fluid outlet and the outlet pipe;

a pin extending through an aperture in the diaphragm, wherein the pin fixedly couples the diaphragm between the first plate and the second plate; and a rib on the diaphragm and a groove in at least one of the first and second plates, wherein the rib engages the groove to sealingly couple the diaphragm to the one of the first and second plates.

* * * * *